US006607058B2

(12) United States Patent
Angerbauer et al.

(10) Patent No.: US 6,607,058 B2
(45) Date of Patent: Aug. 19, 2003

(54) ROPE BRAKE

(75) Inventors: Erwin Angerbauer, Reutlingen (DE); Roland Bross, Pfullingen (DE); Thomas Reinhardt, Pfullingen (DE)

(73) Assignee: Tre-Erwin Angerbauer-Roland Bross-Thomas Reinhardt Gesellschaft Burgerlichen Rechts, Pfullingen (DE)

( * ) Notice: Subject to any disclaimer, the term of this patent is extended or adjusted under 35 U.S.C. 154(b) by 0 days.

(21) Appl. No.: 09/871,677

(22) Filed: Jun. 4, 2001

(65) Prior Publication Data

US 2001/0047912 A1 Dec. 6, 2001

(30) Foreign Application Priority Data

| | | |
|---|---|---|
| Jun. 2, 2000 | (DE) | 100 27 559 |
| Sep. 21, 2000 | (DE) | 100 47 472 |
| Dec. 15, 2000 | (DE) | 100 62 785 |
| Dec. 21, 2000 | (DE) | 100 63 840 |

(51) Int. Cl.[7] ..... A63B 29/02
(52) U.S. Cl. ..... 188/65.1; 182/5; 182/6
(58) Field of Search ..... 188/65.1–65.5; 182/5, 6

(56) References Cited

U.S. PATENT DOCUMENTS

| | | | | |
|---|---|---|---|---|
| 4,019,609 A | | 4/1977 | Wagner | |
| 4,678,059 A | | 7/1987 | Bowker | |
| 5,577,576 A | * | 11/1996 | Petzl et al. | 188/65.4 |
| 6,029,777 A | * | 2/2000 | Rogelja | 182/5 |

FOREIGN PATENT DOCUMENTS

| | | |
|---|---|---|
| CH | 593 696 | 12/1977 |
| DE | 31 16 635 | 12/1982 |
| DE | 89 04 030 | 7/1989 |
| FR | 2 554 102 | 5/1985 |
| FR | 2 688 142 | 9/1993 |
| FR | 2 706 314 | 12/1994 |

* cited by examiner

*Primary Examiner*—Christopher P. Schwartz
(74) *Attorney, Agent, or Firm*—Walter Ottesen

(57) ABSTRACT

The invention is directed to a rope brake especially for synthetic fiber ropes such as climbing ropes or the like. The rope brake has a housing which includes a guide device for at least one rope and this guide device can apply a braking action to the rope. The guide device includes at least one opening for the passthrough of at least one rope loop as well as a pin which extends across the opening and is movable in the plane defined by the rope loop. The pin runs within the rope loop and clamps the rope under load in the opening. At least one further cutout is provided on the housing of the rope brake for the purpose of better metering of the braking force. This cutout is provided for additional guidance and/or reversal of a single rope or double rope. Furthermore, at least one stop for the pin is provided on the housing of the rope brake and this stop limits the movement of the pin in the direction of the movement of the pin, which occurs under load of the rope, before reaching its end position made possible by the deformability of the rope. A spring determines the neutral position of the pin and is arranged in the housing so as to be covered whereby an increased operational reliability and simpler manipulation of the rope brake results.

49 Claims, 4 Drawing Sheets

ROPE BRAKE

FIELD OF THE INVENTION

The invention relates to a rope brake, especially a brake for synthetic fiber ropes such as climbing ropes or the like.

BACKGROUND OF THE INVENTION

A rope brake of the above kind is disclosed in German utility model registration 89 04030.9. The housing of this known rope brake comprises essentially two guide webs mounted parallel to each other. The guide webs are rigidly connected to each other and have slots which are mutually coincident. The action of this known arrangement as a rope brake is achieved in that a spring hook is hooked into the two longitudinal slots and a rope loop is placed about the transverse member of the spring hook which extends through the slots. When a load is applied to the rope, the spring hook is displaced within the guide slots in such a manner that the rope loop is clamped between the transverse pin of the spring hook and a transverse pin between the guide webs. The manipulation of a rope brake of this kind is difficult and leads to a time costly physical effort when stiffer and/or thicker ropes are used. Furthermore, the braking action occurs only with use of two separate parts which must be assembled first in a correct manner by the user.

SUMMARY OF THE INVENTION

It is an object of the invention to provide a rope brake which is easy to manipulate and which provides a wide area of application and a high level of security and safety. The application is intended for the area of climbing sports to make possible the safety of persons climbing ahead and climbing after as well as the use as a rope-down apparatus and as a rope clamp. The application in both cases is for a simple rope as well as with a double rope.

The rope brake of the invention is for a rope including a climbing rope made of synthetic fiber. The rope brake includes: a housing; a guide arrangement for applying a braking action to the rope and the guide arrangement being disposed on the housing; the guide arrangement including at least one opening formed in the housing for passing a loop of the rope therethrough with the loop defining a plane; and, a pin extending across the opening and extending though the loop so as to be grasped thereby; and, the pin being mounted on the housing so as to be movable in the plane.

With the invention, one obtains a light, self-blocking apparatus which requires no additional parts, such as additional spring hooks. The manipulation is simple for all applications and the safety is high especially because a rope, which is guided in the brake, is automatically clamped tight under an adequately strong load or for a slight pull on the brake rope so that, to secure the load, no holding force is required. The insertion of the rope as well as its loosening can be carried out after a loading without difficulties.

It has been proven useful to configure the opening in the housing as a slot. It is especially advantageous when two openings are arranged for the passthrough of two rope loops one next to the other and the braking pin spans the two openings from the top. However, in lieu of two separate openings, a wider opening can be provided which corresponds to the total thickness of the two ropes or a single opening corresponding to the thickness of the used rope when the brake is designed for only one rope.

The braking action of the rope brake arises in a very simple manner in that the pin, which spans the opening or openings, is displaceable in the direction of the opening in the housing or in the plane defined by the rope loop, so that, under load, the rope loop is clamped between the pin and the housing. The insertion of the rope is especially easy because of a simultaneously pivotable arrangement of the pin.

As long as the rope is not under load, that is, with rope feed and with rope payout, the pin is secured by a spring and a latch against pivoting, preferably by a spring and additional ribs on the housing or by a spring element and a stop of a guide element connected to the brake pin. This stop is advantageously provided on a bearing block in which the guide element of the pin is held longitudinally displaceable as well as pivotably. The same spring furthermore effects that the pin during rope feed or payout is held in its neutral position wherein the rope is free of clamping and can slide in the opening. The guide element can, in addition, be displaceable in its longitudinal direction and therefore also in the displacement direction of the brake pin so that the unloaded position of the pin or the adjustment path for braking is adjustable by clamping the rope.

An attachment device is provided on the housing for attaching a body, which is to be braked, to the rope brake when roping down or for attaching the rope brake to the person operating the rope brake or in the area of the person. This attachment device comprises, for example, an attachment pin between two lateral webs on the housing of the rope brake in combination with a band loop which makes the use of an additional spring hook unnecessary or of an attachment opening directly in a housing wall. In lieu of a band loop, a spring hook can be hooked directly into the attachment device. In lieu of the attachment pin between two lateral webs on the housing, it can be advantageous to provide a single center web on the housing with one or several cutouts for looping in the rope loop or a spring hook. The cutouts are arranged in different positions to the opening(s) for the rope passthrough. The braking force is determined by the position of the attachment device or the attachment opening relative to the displacement direction of the brake pin. The closer the attachment point comes to the displacement direction of the brake pin, the greater is the braking force of the rope brake of the invention. For this purpose, several attachment possibilities, which can be used selectively, are provided. In lieu of separate attachment points, it would, however, for example, also be possible to guide the attachment device in a slot against the force of a spring so that the brake force changes in dependence upon the spring force or the spring pretensioning and therefore in dependence upon the position of the attachment device which results.

It has been shown especially advantageous in practice, when at least one additional cutout for additional guidance and/or reversal of a simple or double rope is provided which is preferably configured to be open and serves for the guidance and/or reversal of the brake rope.

For limiting the brake force to protect against overloading, damage or injury, it has been further shown to be advantageous when at least one stop for the pin is provided on the housing which limits the movement of the pin in the direction of movement of the pin which occurs during loading of the rope, before reaching its possible end position. This end position is caused by the deformability of the rope.

In a constructive context, it has been shown advantageous when the spring is mounted covered in the housing and preferably in a blind hole arrangement in the actuating lever. In this way, one obtains a rope brake which is improved with respect to its operational safety, manipulability and resistance to disturbance. Damage or operational disturbance of the spring, which coacts with the brake pin, is substantially precluded.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
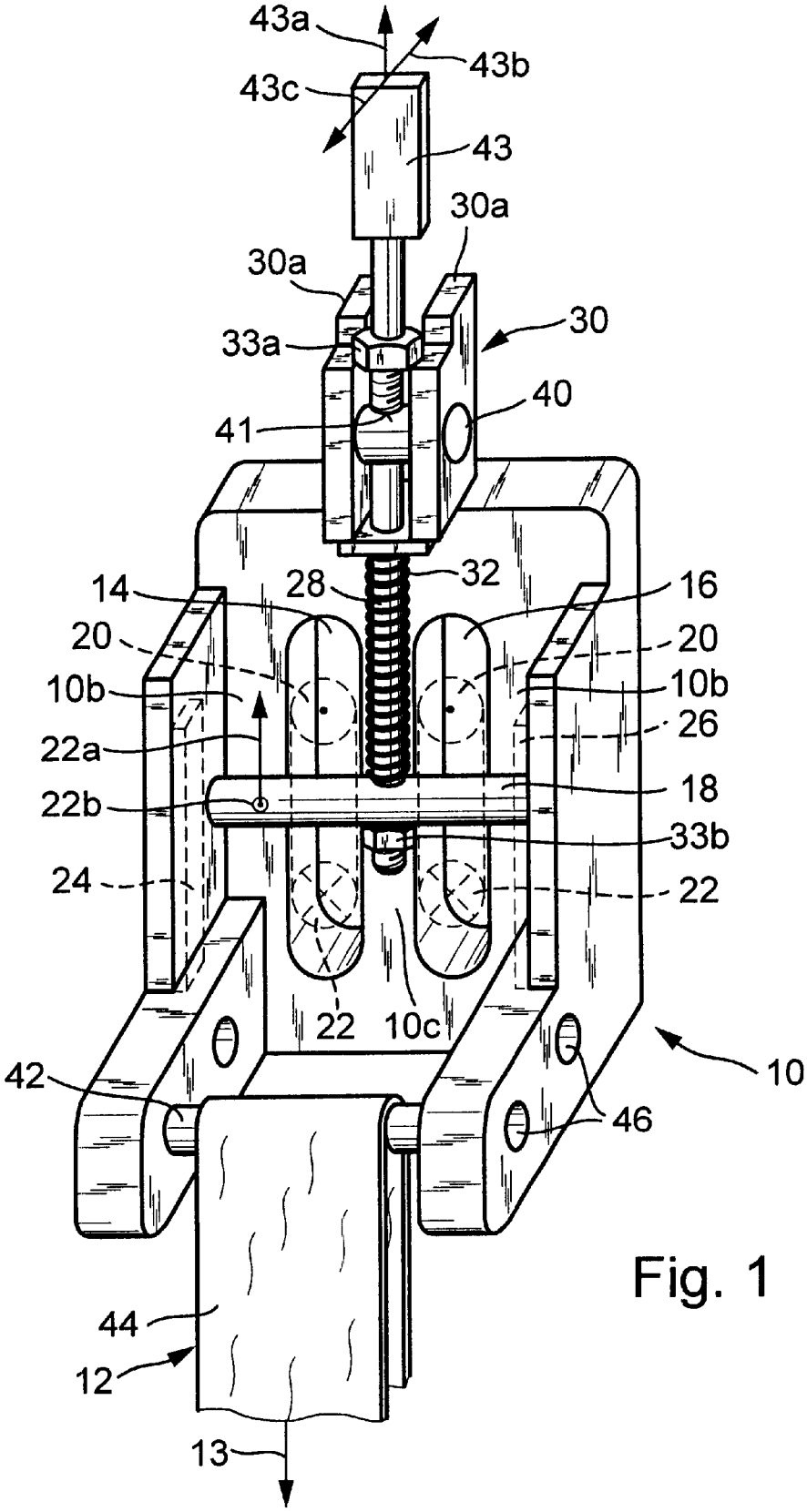
FIG. 1 is a schematic perspective view of the rope brake according to an embodiment of the invention.

In FIG. 1, reference numeral 10 identifies the housing of a rope brake which, as essential components, includes an attachment device 12 and a guide arrangement for the rope. The guide arrangement contains two slot-like openings (14, 16) over which a bolt-like pin 18 extends which hereinafter is identified as a brake pin because of its function. In the upper portion of openings 14 and 16, the rope entry is shown in phantom outline and identified by reference numeral 20. In the lower portion of the slot-like openings 14 and 16, the corresponding respective rope exit 22 is also shown in phantom outline and disposed at the other side of the pin 18. This rope defines the holding rope which is subjected to the body to be braked, that is, which is subjected to the particular load connected to the attachment device 12. The rope entry 20 defines the brake rope. The two ropes shown pass through respective ones of the openings (14, 16), while forming a rope loop. The rope loops engage about the pin 18 spanning the openings (14, 16). Here, the rope entry 20 (that is, the brake rope) is always on the side of a bearing block 30 (described below) while the rope exit 22 (that is, the load rope or holding rope) is always located on the side of the attachment device 12.

The pin 18 is displaceable in the longitudinal direction of the openings (14, 16) and is simultaneously pivotable relative to the openings (14, 16) out of the plane of the drawing. The displacement direction is indicated by arrow 22*a* and the pivot direction is indicated by the arrow tip 22*b*. The pin 18 lies on the housing 10 under the rope load and is guided on the lateral sections (10*a*, 10*b*) as well as on the center section 10*c* of the housing between the two slot-like openings (14, 16). The position of the pin 18 shown in FIG. 1 defines the neutral position for a rope input or for a rope output without clamping. There is sufficient space on both sides of the pin 18 for the passthrough of the rope segments of the rope loop so that the rope does not snag and slides with low friction losses. The width of the openings (14, 16) determines the maximum thickness of the useable rope. In this region, the pin 18 is secured by housing ribs (24, 26) against pivoting in the direction of the arrow tip 22*b* and this is so over the entire length of the housing ribs (24, 26). The housing ribs are indicated in phantom outline in the drawing because they form only one of several possibilities for securing the brake pin 18 against pivoting. This security is necessary so that the unloaded rope cannot slip out of the rope brake.

The pin 18 is coupled to a bearing block 30 via a rod-shaped guide element 28. The guide element 28 is held in the bearing block 30 so as to be longitudinally displaceable and to be pivotable. A helical spring 32 is arranged on the guide element 28 between the pin 18 and the bearing block 30. The pretensioning of the helical spring 32 in the embodiment shown can be adjusted by means of nuts (33*a*, 33*b*) together with the length of the guide element 28. This adjustability is not, however, necessary in the normal case. Since the bearing block 30 is fixedly connected to the housing 10, the length of the guide element 28 determines the position of the pin 18. Starting from this position, and when the rope is under load, the pin 18 is displaced in the direction of arrow 22*a* whereby the rope entry end 20 is clamped between the pin 18 and the housing 10 in the region of the upper ends of the openings (14, 16) and held. In this way, and for adequately high rope loads, an automatic braking and securing is developed when the force of the load operates on the rope exit 22. When, for example, during roping down, the body to be braked or the load applies a force 13 downwardly in the region of the attachment device 12, then the braking force is developed in the direction of arrow 22*a* by the exiting end 22 of the rope, that is, with the load rope leading upwardly in the region of the rope outlet 22.

The pivoting of the pin 18 facilitates threading in the rope or ropes, that is, threading the rope loops about the pin 18. With the pin 18 pivoted out, the rope loops are passed through the openings (14, 16) and are placed about the two ends of the pin 18 which is thereafter pivoted back into the housing. The holding force in the housing is applied by the spring 32. Additionally, the pin is secured against pivoting by the upper nut 33*a* which lies against a projection 30*a* of the bearing block 30. A bearing pin 40 is provided for the displaceable and pivotable holding of the guide element 28 in the bearing block 30. The bearing pin 40 is mounted so as to be rotatable in the bearing block 30. The guide element 28 passes through a bore 41 in the bearing pin 40 wherein it is held and guided. A lever 43 is configured as a single piece with the guide element 28. The lever 43 makes possible the actuation of the pin 18 via the guide element 28. The actuation directions of the lever 43 are indicated by arrows 43*a*, 43*b* and 43*c*. The arrow directed upwardly corresponds to the arrow 22*a* and identifies the displacement direction of the lever 43 in the braking position of the pin 18. Perpendicularly to the pin 18, the arrow 43*b* identifies the direction of movement of the lever 43 for pivoting the pin 18 when inserting the rope loops. To reduce the braking force or to loosen the rope, the lever 43 is pressed in the direction of arrow 43*c* whereby the entire rope brake is pivoted.

The attachment device for the load or body to be braked includes a band loop 44 which engages about the attachment pin 42 and is connected with its end (not shown) to the body, which is to be secured, when roping down. When securing a person climbing ahead or a person climbing up from below, the band loop 44 is connected to a fixed point or to the body of the securing person. The attachment pin 42 is selectively held in various bores 46 and the distance perpendicular to the displacement direction of the pin 18 determines the braking force of the rope brake. The further away the attachment pin 42 is arranged from the displacement direction of the pin 18, the less becomes the braking force because the rope pull generates a braking force only with its vector component in the direction of arrow 22*a*; whereas, the force component in the direction of arrow 22*b* is taken up by the housing 10. In this way, the braking force can be adapted to the requirements. In lieu of the arrangement of the attachment pin 42 in discrete bores 46, a slot can be provided wherein the attachment pin 42 is held against the force of a spring whereby an automatic adaptation of the braking force would be achievable to the weight of the body to be braked. A slot of this kind would have to run at a suitable angle in the region between the arrow directions 22*a* and 22*b*.

The rope brake of the invention described herein makes possible the securing of a person climbing ahead as well as of a climbing person following from below. The rope brake can, however, also be used for roping down and as a rope clamp and for single rope technology as well as double rope technology. When roping down, the braking action is reduced in that a force is applied to the lever 43 in the direction of arrow 43*c* whereby the housing is tilted and the clamping action between the pin 18 and the edge of the openings (14, 16) becomes less. Furthermore, by means of the lever 43, the clamping force on a blocked rope can again be removed in a simple manner, for example, after a plunge when climbing. Here, it is important that the rope tightly clamps automatically under load so that no hand is necessary on the securing rope after loading.

The advantageous possibility is noted that the rope can be threaded from the hang-up point without loosening the brake because, after pivoting the pin 18, only a rope loop need be passed through the opening 14 or 16 and placed around the pin 18. For pivoting the pin 18, the lever 43 must first be pulled with the guide element 28 so far in the direction of arrow 43*a* until the latching by the projection 30*a* and the nut 33*a* (that is, by the housing ribs 24 and 26) is canceled. In this way, the locking is inhibited and the rope brake is released, that is, opened. On the other hand, a light pulling on both ends of the rope loop is sufficient to pull the pin 18 into the housing and to secure the same by latching. The position shown in FIG. 1 of the pin 18 is maintained as long as no large forces operate on the rope. Lower forces because of rope friction and the weight of the rope itself are compensated by the spring 32. In the case of loading, the rope pull of the rope, which leads upwardly, acts on the section of the rope loop which is characterized as the exit portion of the rope 22 (load rope). In this way, the brake pin 18 moves upwardly in the direction of arrow 22*a*, the spring 42 is compressed and the guide element 28, which is connected to the pin 18, glides so far through the bore 41 in the bearing pin 40 until the section of the rope loop, which is characterized as the rope entry portion 20 (braking rope), is clamped between the pin 18 and the upper edge of the slot-like opening 14 or opening 16. Simultaneously, the length of the lever 43 is thereby lengthened which especially facilitates the lever action when loosening the brake and thereby its actuation.

When used, the rope brake is always with the person to be secured. In the case of roping down, it is the person roping down and the force acts downwardly in the direction of the arrow because the band loop 44 is attached to the load (here, the belt of the person roping down). When a person climbing ahead is secured, approximately the same position of the rope brake results because the exit end 22 of the rope, that is, the load rope, leads upwardly. When securing a follow-on climbing person, the work position of the work brake turns around because the force 13 and the band loop 44 are directed upwardly to a fixed point.

Figure 2:
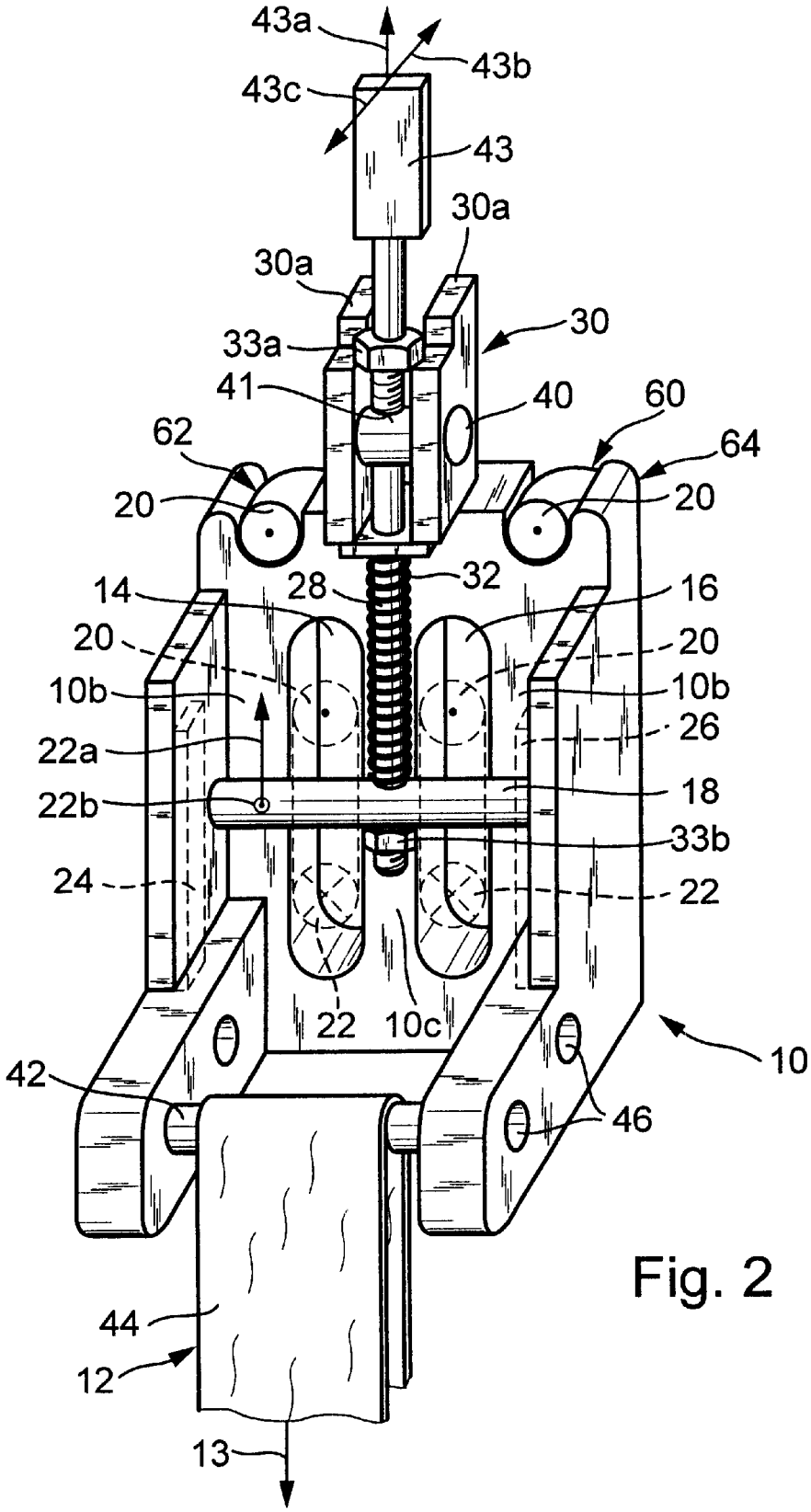
FIG. 2 shows the rope brake of FIG. 1 supplemented with cutouts showing the rope or ropes looped around.
Figure 3:
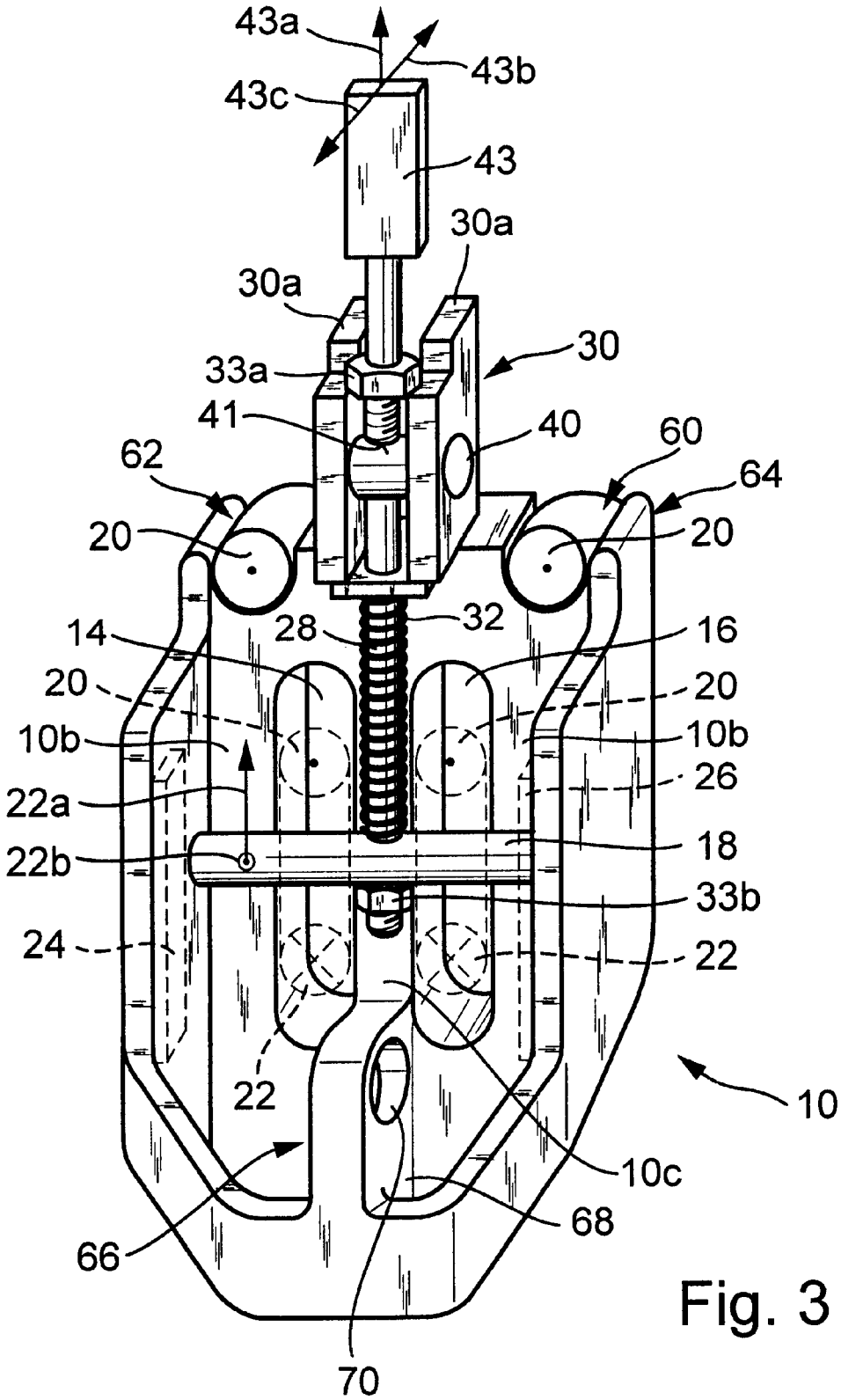
FIG. 3 shows the embodiment of FIG. 2 with a hang-up point in the region of the center web on the housing.

Other embodiments according to FIG. 1 are shown in FIGS. 2 and 3 and explained hereinafter. The same parts are identified by the same reference numerals as in FIG. 1.

Reference numeral 10 again identifies the housing of a rope brake which, as essential components, includes the attachment device 12 and the guide device for the rope. The guide device includes two slot-like openings (14, 16) which, together, are spanned by a bolt-shaped pin 18, which, in the following, is identified also as the brake pin because of its function. In the upper portion of the openings 14 and 16, the rope entry is shown in phantom outline and identified by reference numeral 20 and, in the lower portion of the slot-like openings 14 and 16 on the other side of the pin 18, the respective corresponding exit rope portions 22 are shown. The exit rope portion 22 defines the load rope (that is, the holding rope) which is subjected to the load of the body to be braked or with the particular load which is connected to the attachment device 12. The entry rope portion 20 defines the braking rope. The two ropes shown pass through the respective openings (14, 16) while forming a rope loop. The rope loops engage about the pin 18 which spans the openings (14, 16). The rope entering portion 20, that is, the brake rope, is always located on the side of the bearing block 30; whereas, the rope exit portion 22 (that is, the load rope or holding rope) is always located on the side of the attachment device 12.

The pin 18 is displaceable in the longitudinal direction of the openings (14, 16) and simultaneously pivotable relative to the openings (14, 16) out of the plane of the drawing. The displacement direction is given by arrow 22*a* and the pivot direction is given by arrow tip 22*b*. The pin 18 lies against the housing 10 when the rope is under load and is guided on the lateral sections (10*a*, 10*b*) as well as the center section 10*c* of the housing between the slot-like openings (14, 16). The position of the pin 18 shown in the figure defines the neutral position for a rope input or for a rope output without clamping. Sufficient space is provided for the passthrough of the rope segments of the rope loop on both sides of the pin 18 so that the rope loops do not snag and glide with low friction losses. The widths of the openings (14, 16) determine the maximum thickness of the useable rope. In this region, the pin 18 is secured by the housing ribs (24, 26) against pivoting in the direction of the arrow tip 22*b* and this locking is provided over the entire lengths of the housing ribs (24, 26). This locking is necessary so that the unloaded rope cannot slip out of the rope brake.

The pin 18 is coupled to the bearing block 30 via a rod-shaped guide element 28. The guide element 28 is longitudinally displaceable and held pivotable in the bearing block 30. A helical spring 32 is arranged on the guide element 28 between the pin 18 and the bearing block 30 and the pretensioning of the helical spring together with the length of the guide element 28 is adjustable by the nuts (33*a*, 33*b*) in the embodiment shown. The bearing block 30 is fixedly connected to the housing 10 and therefore the length of the guide element 28 determines the position of the pin 18. Starting from this position, the pin 18 is displaced in the direction of arrow 22*a* when the rope is under load whereby the rope entry portion 20 between the pin 18 and the housing 10 is clamped in the region of the upper end of the openings (14, 16) and held. In this way, with a sufficiently high rope load, an automatic braking and latching results when the force of the load acts on the rope exit portion 22. When, for example, during roping down, the body to be braked (that is, the load), develops a force downwardly in the region of the attachment device 12, the braking force in the direction of arrow 22*a* is developed with the rope exit portion 22 (that is, with the load rope), which leads upwardly, in the region of the rope exit portion 22.

The pivoting of the pin 18 makes possible threading in the rope or ropes; that is, the pivoting makes possible the threading in of the rope loops about the pin 18. With the pin 18 pivoted out, the rope loops can be passed through the openings (14, 16) and placed about the two ends of the pin 18 which is thereafter pivoted back into the housing. The holding force in the housing is applied by the spring 32. In addition, the pin is secured against pivoting by the upper nut 33*a* which lies against a projection 30*a* of the bearing block 30. The bearing pin 40 is provided in the bearing block 30 for the displaceable and pivotable holding of the guide element 28 in the bearing block 30. The bearing pin 40 is rotatably mounted in the bearing block 30. The guide element 28 passes through the bore 41 in the bearing pin 40 in which it is held and guided. The lever 43 is configured as one piece with the guide element 28 and the lever makes possible the actuation of the pin 18 via the guide element 28. The actuation directions of the lever 43 are indicated by arrows 43*a*, 43*b* and 43*c*. The arrow upwardly corresponds to the arrow 22*a* and identifies the displacement direction of the lever 43 in the braking position of the pin 18. The arrow 43*b* is perpendicular to the pin 18 and identifies the direction of movement of the lever 43 to pivot the pin 18 when inserting the rope loops. To reduce the braking force or for loosening the rope, the lever 43 is pressed in the direction of arrow 43*c*. The entire rope brake is pivoted about the rotation point of the hang-up.

The attachment device 12 for the load to be braked (that is, the body to be braked), has in the embodiment of FIG. 2 a band loop 44 which engages about the attachment pin 42 and is connected to the load or the body to be secured with the end (not shown) when roping down. When securing a person climbing ahead or a person climbing after, the band loop 44 is connected to a fixed point or to the body of the securing person. The attachment pin 42 is selectively held in various bores 46 whose perpendicular distance to the direction of displacement of the pin 18 determines the braking force of the rope brake. The further the attachment pin 42 is arranged from the direction of displacement of the pin 18, the lower becomes the braking force because the rope pull generates a braking force only with its vectorial component in the direction of arrow 22*a*; whereas, the force component in the direction of arrow 22*b* is taken up by the housing 10. In this way, the braking force can be adapted to the requirements.

An improvement of the meterability of the braking force results by respective cutouts 60 and 62 at the upper end of the housing above the respective slot-like openings 14 and 16 in which the braking rope 20 is inserted when roping down or lowering. In this way, an additional directional change in the rope guidance results with the aid of which the operator can additionally control the braking force. The cutouts 60 and 62 are each open in the form of a sector of a circle or are configured as an oval and afford thereby an excellent guidance for the rope. Additional cutouts 60 and 62 are assigned to the pass-through openings 14 and 16, respectively. For this reason, this embodiment too is appropriate with use for a single rope as well as a double rope. The cutouts (60, 62) do not disturb when manipulating the unloaded rope because of their open configuration and arrangement in the region of the housing edge 64. On the other hand, with this additional reversal of direction, it is avoided in an especially simple and advantageous manner that a sudden release of the braking force occurs when the lever 43 is actuated in the direction of arrow 43*c* to reduce the braking force when the lever 43 is pulled too suddenly or with too much force in the direction of arrow 43*c*. An abrupt reduction of braking force when roping down or when lowering is thereby avoided and there is no yes/no position of the lever 43 because, with the additional reversal of direction of the braking rope 20, a minimum amount of braking force is always ensured when the blocking release lever 43 is actuated and the housing rotated thereby and the braking force is reduced.

The embodiment of FIG. 3 corresponds in function to the embodiment of FIG. 2 and is configured in the same manner with the exception of the attachment device. To attach a load, and especially the person to be secured, a single center web 68 is provided in extension of the center section 10*c* of the housing in lieu of two lateral webs and a strut between these two webs. The hang-up point 66 of the rope brake is defined by an insert opening 70 in the web 68. The braking force in this embodiment too is determined by the spacing of the hang-up point 66 from the displacing plane of the pin 18. To change the braking force, the configuration of the web 68 and the insert opening 70 is changed so that this distance changes relative to the displacing plane of the pin 18. The farther away the hang-up point 66 is from the displacement direction of the pin 18, the less is the braking force. The lower part of the housing is modified in the arrangement of FIG. 2 in that the lower lateral portions of the housing 10 run directly to the web 68 and support this web at its outer end while the inner end of the web 68 is configured as one piece with the center section 10*c* of the housing.

This rope brake also makes possible the securing of persons climbing ahead and climbing after and can also be used when roping down and as a rope clamp in a single rope or double rope configuration. When roping down, the braking action is reduced in that a force in the direction of arrow 43*c* is applied to the lever 43 whereby the housing is tilted and therefore the clamping action reduces between the pin 18 and the edge of the openings (14, 16). Furthermore, the clamping force on a blocking rope can again be lifted by means of the lever 43 in a very simple manner, for example, after a plunge of a climber. Here it is important that the rope clamps automatically under load, so that no hand is necessary on the securing rope after a load is applied.

Figure 4:
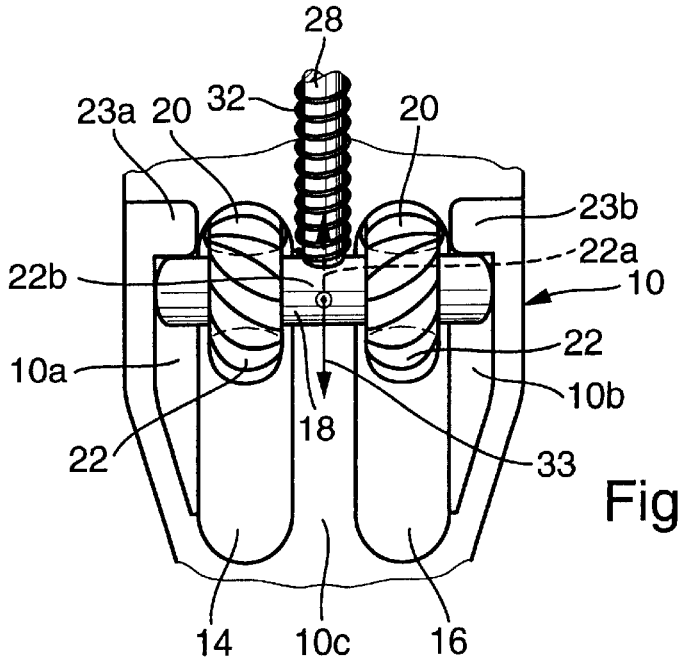
FIG. 4 shows an embodiment with lateral stops for the brake pin.

The arrangement of FIG. 4 shows another embodiment of the invention for limiting the braking force. This arrangement defines a secure self-blocking apparatus which nonetheless prevents the action of forces which are too high on the person to be secured as well as on the rope itself. A further advantage of this arrangement comprises that the braking force differences between a single and a double rope can be very well compensated. In addition, the use of a double rope ensures a uniform limiting of the braking force on both ropes. For the use with a single rope, this rope is not clamped to a greater extent on one side. The spring simultaneously effects that the unloaded pin is held in its neutral position during rope input or rope output wherein the rope, deviating from the shown clamping position of the brake rope, can glide clamp-free over the pin and through the openings provided in the housing.

In FIG. 4, the rope brake according to the invention is shown only in a detail view and is discussed only to this extent in the following. The complete configuration and arrangement of the rope brake is presented in FIGS. 1 to 3.

In FIG. 4, the same parts are again provided with the same reference numerals as in FIGS. 1 to 3. The rope entry portion 20 (that is, the corresponding rope section) forms the brake rope. The two ropes shown again pass through the openings (14, 16) while forming respective rope loops. The condition shown in FIG. 4 corresponds to the braking position. In FIG. 4, the rope entry portion 20 continues upwardly in the form of a braking rope; whereas, on the other side below the brake pin 18, the rope continues as a load or holding rope. The attachment device for the rope brake (not shown) is on this lower side.

The displacement direction of the pin 18 for braking is indicated by arrow 22*a* and the pivot direction is indicated by arrow tip 22*b*. In the unloaded state, the pin 18 is displaced into a neutral position by a spring 32 in the direction of arrow 33. In this neutral position, the two ropes can slide substantially free through the openings (14, 16). The pin 18 lies against stops 23*a* and 23*b* when the rope is under load. The stops limit the movement of the pin 18 in the direction of movement, which occurs when the rope is subjected to a load, before reaching its end position made possible by the maximum deformability of the rope. The position is defined by an adequate but not unwanted high braking force.

The two stops 23*a* and 23*b* project at the same elevation laterally from the housing into the path of movement of the pin 18 and determine the end position of the pin under load. Here, the pin 18 is subjected to the rope forces, on the one hand and, on the other hand, to the force of the spring 32 and, because of this action, the pin 18 lies against the guide sections 10*a* and 10*b* of the housing which run in the displacement direction of the pin 18 on the base of the housing 10 from the lateral housing walls up to the openings (14, 16). The stops 23*a* and 23*b* extend perpendicularly to the direction of movement 22*a* (that is, 33 of pin 18) and correspond, with respect to their lengths engaging on pin 18 approximately the widths of the guide sections 10*a* and 10*b*. On the other hand, the elevation of the stops 23*a* and 23*b* (that is, their extension perpendicular to the direction of movement of the pin 18) is so selected that a secure contact of the pin 18 is ensured. The elevation of the stops 23*a* and 23*b* should amount to approximately the thickness or twice the thickness of the pin 18. The stop surfaces of the stops 23*a* and 23*b* on the pin 18 run likewise approximately perpendicular to the direction of movement of the pin 18.

The remainder of the configuration of the rope brake according to the invention corresponds to the embodiments described above and reference is made thereto. FIG. 4 therefore shows neither the attachment device for the load (that is, the person to be secured) nor the actuating device of the rope brake of which only a guide element 28, which engages on the brake pin 18, with the helical spring 32 gliding thereon are shown. FIG. 4 shows the helical spring 32 in the tensioned condition because the brake pin 18 is displaced from its neutral position into the brake position. The braking condition illustrated shows that the rope is clamped to achieve the necessary braking force between the pin 18 and the upper ends of the openings 14 and 16; however, only to such an extent that the required and wanted braking force is reliably achieved but not exceeded.

As shown in the above embodiments, the pin 18 can be pivoted in the direction of arrow tip 22*b* from the plane of the drawing in order to make possible an easy threading-in of the rope or ropes in that, for the out-pivoted pin 18, respective rope loops are threaded through the openings 14 and 16 and are placed around the ends of the pin 18. With the force of the spring 32, a neutral position of the pin 18 is maintained as long as no large forces act on the rope. Lower forces because of rope friction and/or the weight of the rope itself are compensated by the spring 32. In the case of loading, the rope pull of the load rope operates on the section of the rope loop which is characterized as rope entry portion 22. For this reason, the brake pin 18 moves upwardly in the direction of arrow 22*a* and the spring 32 is pressed together and the pin 18 moves upwardly to the stops 23*a* and 23*b* in the direction of arrow 22*a* so that the rope is clamped and braked with the wanted and pregiven braking force.

Figure 5:
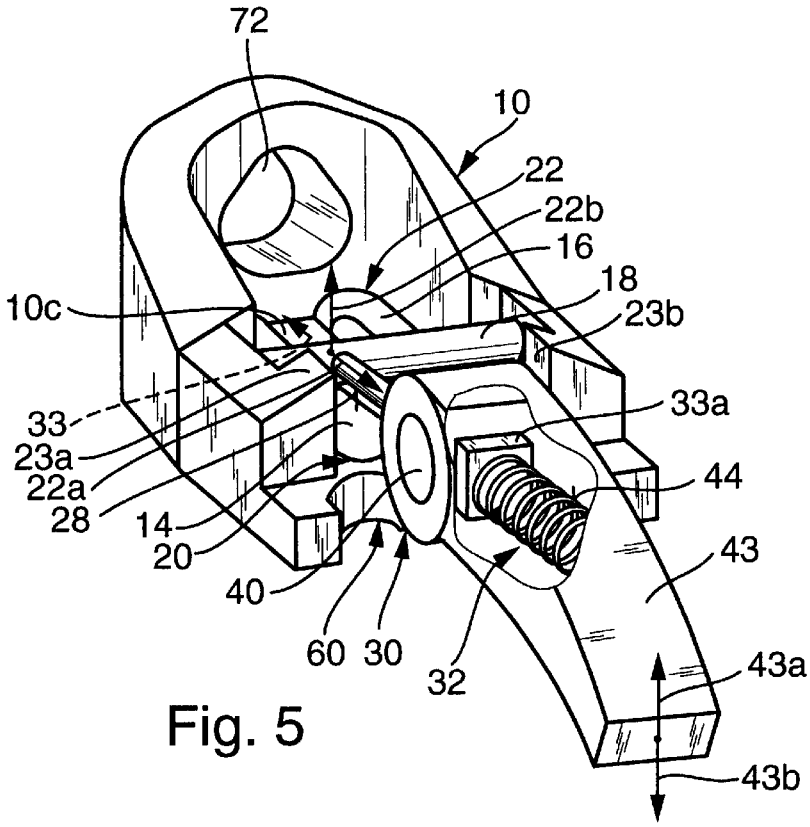
FIG. 5 shows an embodiment having a spring protected in the actuation lever.

FIG. 5 shows another embodiment of the invention wherein especially damage or a disturbance to the function of the spring, which coacts with the brake pin, is substantially precluded.

With this embodiment, an arrangement is obtained which is protected against foreign bodies, dirt, icing or the like. In this arrangement, the operational reliability is ensured especially by a disturbance-free, constant spring action of the spring coacting with the brake pin. The arrangement of the spring in a hollow space of the actuating lever furthermore permits a permanent slide lubrication of the spring as well as the adjacent parts of the rope brake. Furthermore, with the suggested arrangement, it is achieved that for the transition from the neutral position into the braking position, no movable parts (especially not the guide element of the brake pin) are moved out of the housing toward the outside and therefore defective operations are avoided.

Here, it has been especially shown to be advantageous when the spring is mounted in a blind hole in the actuating lever. In this kind of configuration, the spring is completely protected against external influences of a mechanical nature and from effects caused by environmental influences. At the same time, a compact configuration of the entire rope brake results when the cutout in the actuation lever and the spring itself are so configured that the guide element for the brake pin is displaceable by the spring into the blind hole in the actuating lever. An especially simple adjusting possibility for the spring force results when the spring at its end, which faces away from the base of the blind hole, engages on a stop nut adjustable by a winding on the guide element.

In FIG. 5, the same or similar parts are provided with the same reference numerals as in FIGS. 1 to 4 and therefore not described again. The rope or ropes are not shown in FIG. 5 for the sake of clarity. On the left side, the rope entry portion 20 can be seen and, on the right side of the opening 16, the rope exit portion 22 can be seen. This side of the opening 16 lies opposite referred to the pin 18. The rope exit portion 22 corresponds to the holding rope which is loaded with the body to be braked or with the particular load when braking. The rope entry portion 20 corresponds to the braking rope. The ropes (not shown) again pass through the openings (14, 16) while forming respective rope loops and engage around the pin 18.

The pin 18 is displaceable in the longitudinal direction of the openings (14, 16) and is simultaneously pivotable out of the plane of the drawing relative to the openings (14, 16). The displacement direction is given by arrows 22*a* or 33 and the pivot direction is given by arrow 22*b*. Here, the displacement direction 22*a* corresponds to the displacement of the pin 18 when braking and the displacement direction 33 results when loosening the rope, that is, when the brake pin is moved back by the spring into its neutral position. The pivot direction 22*b* results from a manual actuation of an actuating lever 43 in the unloaded state of the rope brake and especially for inserting the rope or ropes when the pin 18 is pivoted out in the direction of arrow 22*b*.

In the broken away portion of the actuating lever 43, a helical pressure spring 32 can be seen which is guided and held within a blind hole 44 in the lever 43. The spring 32 braces on the base of the hollow space, on the one hand (that is, blind hole 44) and, on the other hand, at a stop nut 33*a* which is adjustably mounted on a winding (not shown) of the guide element 28 for adjusting the pretension of the spring 32.

The pin 18 lies against the housing 10 under the spring force and/or under the rope load and is guided on guide sections (not shown) of the housing laterally of the openings (14, 16) as well as on a center guide section 10*c* between the slot-like openings (14, 16). The position of the pin 18 shown in FIG. 5 defines the neutral position or inputting rope or for paying out rope without clamping the rope. Sufficient room is provided in this position for the passthrough of the rope sections of the rope loop on both sides of the pin 18 so that the rope portions can slide with low friction losses in the openings (14, 16).

The pin 18 is coupled to the bearing block 30 via the rod-shaped guide element 28. The guide element 28 is held in the bearing block 30 so that it is longitudinally displaceable and is pivotable. On the guide element 28, the spring 32 is arranged in the blind hold 44 on the side of the bearing block 30 lying opposite to the pin 18. The bearing block 30 is configured as one part or fixed to the housing 10 and accommodates a bearing pin 40 in which the guide element 28 slides. The spring 32 braces either directly on the bearing pin 40 or it lies against the stop nut 33*a* with a changeable pretension. The guide element 28 can slide partially into the spring 32 and into the blind hold 44 whereby a shortening of the structural length of the rope brake results. The pin 18 is moved under a rope load from the neutral position shown in the direction of the arrow 22*a* whereby the rope entry portion 20 is clamped between the pin 18 and the housing 10 in the region of the ends of the openings (14, 16) facing toward the stops (23*a*, 23*b*). In this way, for an adequately high rope loading, an automatic braking and securing results when the force of the load operates on the brake pin 18 in the direction of arrow 22*a*.

The guide element 28 extends through the rotatable bearing pin 40 of the bearing block 30 and is therefore pivotable together with the actuating lever 43. The actuating direction of the lever 43 is given by the arrows 43*c* and 43*b*. A deflection of the lever 43 in the direction of the arrow 43*b* effects a movement of the brake pin 18 in the direction of arrow 22*b* as long as no significant rope force acts on the pin 18. The deflection of the actuating lever 43 in the direction of arrow 43*b* then effects a displacement of the pin 18 beyond the upper housing edge whereby, in turn, an especially simple insertion of one or two ropes is made possible in that rope loops are pushed through the respective openings (14, 16) and are placed about the free ends of the pin 18. Already for a slight rope load and/or under the force of the spring 32, the brake pin 18 returns into the neutral rest position and, in this position, makes possible a guidance of the rope without significant friction. In the case of loading, that is, for a brake pin displaced in the direction of arrow 22*a* and a clamped rope between the brake pin 18 and the ends of the openings (14, 16), which lie in the direction of arrow 22*a*, an actuation of the lever 43 in the direction of arrow 43*c* effects a reduction of the braking force because the movement of the actuating lever 43 in the direction of arrow 43*c* simultaneously pivots the entire housing 10 of the rope brake and thereby the rope pull and the braking force is reduced in the direction of the arrow 22*a*. This reduction of the braking force also arises for the arrangement of FIG. 5 because of the reduced vector brake component of the rope pull after tilting of the actuating lever 43 and of the housing 10 in the direction of arrow 43*c*. Here, the position of the attachment opening 72 is significant because the braking force is that much less for the same clamping action of the pin 18 the more the actuating opening 72 is displaced for the load to be braked in the direction of the arrow 22*b* relative to the clamp point of the rope. The attachment takes place in such a manner that for securing a climber advancing ahead or one coming from behind, the attachment means, which is guided through the attachment opening 72, is connected to a fixed point or to the body of the person to be secured.

With the arrangement of the spring 32 in a hollow space 44 (preferably a blind hole) in the actuating lever 43, the spring 32 is protected against contact with the ropes and possibly against damage caused thereby. This is in addition to other unwanted effects on the spring 32. When a brake force occurs, the spring is pressed together in the blind hole 43 by the guide element 28 via the stop nut 33*a*. At the same time, the guide element 28 is partially pressed into the spring 32 in the blind hole 44.

It is understood that the foregoing description is that of the preferred embodiments of the invention and that various changes and modifications may be made thereto without departing from the spirit and scope of the invention as defined in the appended claims.

What is claimed is:

1. A rope brake for a rope including a climbing rope, the rope brake comprising:

a housing;

a guide arrangement for applying a braking action to said rope and said guide arrangement being disposed on said housing;

said guide arrangement including at least one opening formed in said housing for passing a loop of said rope therethrough with said loop defining a plane; and, a pin extending across said opening and extending though said loop so as to be grasped thereby;

pivot means for pivotally mounting said pin on said housing so as to be pivotally movable in said plane; and, means for also displaceably moving said pin along said opening.

2. The rope brake of claim 1, wherein said opening in said housing is a slot-like opening.

3. The rope brake of claim 2, wherein said slot-like opening is a first slot-like opening and said loop is a first loop; and, said guide arrangement includes: a second slot-like opening adjacent said first slot-like opening and formed in said housing for passing a second loop of rope therethrough; and, said pin extending across both of said slot-like openings and also extending through said second loop so as to be grasped thereby.

4. The rope brake of claim 3, said guide arrangement further including first and second edge sections on said housing against which said pin can be placed.

5. The rope brake of claim 3, said guide arrangement further including a center section disposed on said housing between said first and second slot-like openings and against which said pin can be placed.

6. The rope brake of claim 3, said guide arrangement including a device mounted on said housing for facilitating the movement of said pin in the direction of said openings.

7. The rope brake of claim 1, wherein said guide arrangement includes a bearing block mounted on said housing; a guide element for coupling said pin to said bearing block; and, said bearing block including means for holding said guide element so that said guide element can be longitudinally displaced and/or pivoted.

8. The rope brake of claim 7, said guide arrangement further including a spring disposed between said pin and said bearing block.

9. The rope brake of claim 7, said means including a pivot pin for holding said guide element therein so as to be both longitudinally displaceable and pivotable.

10. The rope brake of claim 1, said housing defining a longitudinal axis; and, said pivot means comprising:

a lever connected to said pin and said lever being pivotably movable between a first position wherein said pin is next to said opening and a second position wherein said pin is pivoted away from said opening; and, a locking device for releasably locking said lever in said first position wherein said lever is rigid with respect to said housing to facilitate pivoting said rope brake as a whole in a direction transverse to said longitudinal axis thereby changing the braking force applied to said rope by said braking action as the course of said rope changes relative to said longitudinal axis during pivoting of said rope brake as a whole.

11. The rope brake of claim 10, wherein cutout means are formed on said housing in the region of said lever.

12. The rope brake of claim 1, wherein said opening defines a work region of rope input and rope output; and, ribs formed on said housing for guiding said pin thereon in said work region against pivoting.

13. The rope brake of claim 12, said guide arrangement further including means for securing said pin against pivoting via said means while said pin is in said work region.

14. The rope brake of claim 1, wherein said pin has a braking position for braking said rope; and, said rope brake further comprising an attachment device mountable on said housing so as to be at different longitudinal and transverse distances from said braking position.

15. The rope brake of claim 1, wherein said pin lies against said housing when said rope is under load and is guided on said housing.

16. The rope brake of claim 1, wherein said climbing rope is made of synthetic fiber.

17. A rope brake for a rope including a climbing rope, the rope brake comprising:

a housing having at least one opening for passing a loop of said rope therethrough with said loop defining a plane;

a guide arrangement for said rope and said guide arrangement being disposed on said housing and including a pin extending across said opening;

said pin extending through said loop so as to be grasped thereby and being mounted on said housing so as to be movable in said plane;

pivot means for pivotally mounting said pin on said housing so as to be pivotally movable in said plane;

means for also displaceably moving said pin along said opening; and, cutout means formed on said housing in addition to said opening for additionally guiding and/or reversing the direction of a single rope or a double rope.

18. The rope brake of claim 17, wherein said cutout means is configured as an open cutout.

19. The rope brake of claim 18, wherein said cutout is configured to have a shape extending from a sector of an oval to a section of a circle.

20. The rope brake of claim 17, said cutout means being provided for guiding and/or changing the direction of the brake rope.

21. The rope brake of claim 17, wherein said opening is a first opening and said housing has a second opening for passing a loop of rope therethrough; and, said cutout means includes two cutouts corresponding to respective ones of said openings for guiding and/or changing the direction of the rope.

22. The rope brake of claim 17, said housing having a hang-up point for a load or body to be secured; and, said cutout means being arranged on the edge of said housing opposite said hang-up point.

23. A rope brake for a rope including a climbing rope, the rope brake comprising:

a housing having at least one opening for passing a loop of said rope therethrough with said loop defining a plane;

a guide arrangement for said rope and said guide arrangement being disposed on said housing and including a pin extending across said opening;

said pin extending through said loop so as to be grasped thereby and being mounted on said housing so as to be movable in said plane;

at least one stop on said housing for acting directly on said pin to limit the movement of said pin in the direction of movement thereof when a load is applied to said rope before said pin reaches the end position thereof; and, said end position being made possible by the deformability of said rope.

24. The rope brake of claim 23, said stop being a first stop on a first side of said housing; and, said rope brake including a second stop on a second side of said housing; and, said first and second stops extending into the path of movement of said pin.

25. The rope brake of claim 24, wherein said pin lies with the outer ends thereof against said first and second stops which project inwardly from walls of said housing.

26. The rope brake of claim 24, wherein said housing has lateral guide sections; and, said pin engages said stops in the region of said lateral guide sections.

27. The rope brake of claim 24, wherein each of said stops extends a like distance into said path of movement.

28. The rope brake of claim 23, wherein said stops have stop surfaces running approximately perpendicularly to said path of movement of said pin.

29. A rope brake for a rope including a climbing rope, the rope brake comprising:

a housing having at least one opening for passing a loop of said rope therethrough with said loop defining a plane;

a guide arrangement for said rope and said guide arrangement being disposed on said housing and including a pin extending across said opening;

said pin extending through said loop so as to be grasped thereby and being mounted on said housing so as to be movable in said plane in the direction of said opening;

a spring mounted in said housing for applying a resilient biasing force to said pin as said pin is moved in the direction of said opening; and, said spring being mounted in said housing so as to be covered thereby.

30. The rope brake of claim 29, further comprising an actuation lever having a hollow space formed therein; and, said spring being mounted at least partially in said hollow space.

31. The rope brake of claim 30, said hollow space being a blind hole and said spring being mounted at least partially in said blind hole.

32. The rope brake of claim 30, further comprising a guide element for said pin and said guide element extending into said spring and/or said hollow space of said actuation lever.

33. The rope brake of claim 30, wherein said housing includes a bearing block for said actuation lever; and, said spring is braced on said bearing block and in said hollow space of said actuation lever.

34. The rope brake of claim 32, further comprising a stop nut adjustably mounted on said guide element; and, the pretension of said spring being adjustable with said stop nut.

35. The rope brake of claim 29, wherein the pretension of said spring is adjustable.

36. The rope brake of claim 29, wherein said spring is configured as a helical pressure spring.

37. A rope brake for a rope including a climbing rope, the rope brake comprising:

a housing;

a guide arrangement for applying a braking action to said rope and said guide arrangement being disposed on said housing;

said guide arrangement including at least one opening formed in said housing for passing a loop of said rope therethrough with said loop defining a plane; and, a pin extending across said opening and extending though said loop so as to be grasped thereby;

said pin being mounted on said housing so as to be movable in said plane; and, said opening in said housing being a slot-like opening.

38. The rope brake of claim 37, wherein said slot-like opening is a first slot-like opening and said loop is a first loop; and, said guide arrangement includes: a second slot-like opening adjacent said first slot-like opening and formed in said housing for passing a second loop of rope therethrough; and, said pin extending across both of said slot-like openings and also extending through said second loop so as to be grasped thereby.

39. The rope brake of claim 38, said guide arrangement including a device mounted on said housing for facilitating the movement of said pin in the direction of said openings.

40. The rope brake of claim 39, said device including means for also pivoting said pin relative to said first and second slot-like openings.

41. The rope brake of claim 38, said guide arrangement further including first and second edge sections on said housing against which said pin can be placed.

42. The rope brake of claim 38, said guide arrangement further including a center section disposed on said housing between said first and second slot-like openings and against which said pin can be placed.

43. A rope brake for a rope including a climbing rope, the rope brake comprising:

a housing;

a guide arrangement for applying a braking action to said rope and said guide arrangement being disposed on said housing;

said guide arrangement including at least one opening formed in said housing for passing a loop of said rope therethrough with said loop defining a plane; and, a pin extending across said opening and extending though said loop so as to be grasped thereby;

said pin being mounted on said housing so as to be movable in said plane;

said opening defining a work region of rope input and rope output; and, ribs formed on said housing for guiding said pin thereon in said work region against pivoting.

44. The rope brake of claim 43, said guide arrangement further including means for securing said pin against pivoting via said means while said pin is in said work region.

45. A rope brake for a rope including a climbing rope, the rope brake comprising:

a housing;

a guide arrangement for applying a braking action to said rope and said guide arrangement being disposed on said housing;

said guide arrangement including at least one opening formed in said housing for passing a loop of said rope therethrough with said loop defining a plane; and, a pin extending across said opening and extending though said loop so as to be grasped thereby;

said pin being mounted on said housing so as to be movable in said plane; and, said guide arrangement including a bearing block mounted on said housing; a guide element for coupling said pin to said bearing block; and, said bearing block including means for holding said guide element so that said guide element can be longitudinally displaced and/or pivoted.

46. The rope brake of claim 45, said guide arrangement further including a spring disposed between said pin and said bearing block.

47. The rope brake of claim 45, said means including a pivot pin for holding said guide element therein so as to be both longitudinally displaceable and pivotable.

48. A rope brake for a rope including a climbing rope, the rope brake comprising:

a housing having at least one opening for passing a loop of said rope therethrough with said loop defining a plane;

a guide arrangement for said rope and said guide arrangement being disposed on said housing and including a pin extending across said opening;

said pin extending through said loop so as to be grasped thereby and being mounted on said housing so as to be movable in said plane;

cutout means formed on said housing for additionally guiding and/or reversing the direction of a single rope or a double rope;

a lever pivotally mounted on said housing to function as an actuating device and/or a locking device; and, said lever being pivotally mounted in the region of said cutout means.

49. A rope brake for a rope including a climbing rope, the rope brake comprising:

a housing having at least one opening for passing a loop of said rope therethrough with said loop defining a plane;

a guide arrangement for said rope and said guide arrangement being disposed on said housing and including a pin extending across said opening;

said pin extending through said loop so as to be grasped thereby and being mounted on said housing so as to be movable in said plane;

at least one stop on said housing for acting directly on said pin to limit the movement of said pin in the direction of movement thereof when a load is applied to said rope before said pin reaches the end position thereof;

said end position being made possible by the deformability of said rope;

said stop being a first stop on a first side of said housing;

said rope brake including a second stop on a second side of said housing;

said first and second stops extending into the path of movement of said pin; and, said pin lying with the outer ends thereof against said first and second stops which project inwardly from walls of said housing.

* * * * *